US006588116B2

(12) United States Patent
Dallas et al.

(10) Patent No.: US 6,588,116 B2
(45) Date of Patent: Jul. 8, 2003

(54) METHOD FOR DRILLING UNDER RIVERS AND OTHER OBSTACLES

(75) Inventors: Tim Dallas, Houston, TX (US); Gary W. Uttecht, Houston, TX (US); Eric Wright, Ellon (GB); Greg Neubauer, Houston, TX (US); James F. Brosnahan, Houston, TX (US)

(73) Assignee: Gyrodata, Inc, Houston, TX (US)

( * ) Notice: Subject to any disclaimer, the term of this patent is extended or adjusted under 35 U.S.C. 154(b) by 0 days.

(21) Appl. No.: 09/923,034

(22) Filed: Aug. 6, 2001

(65) Prior Publication Data

US 2002/0056201 A1 May 16, 2002

Related U.S. Application Data

(63) Continuation of application No. 09/266,566, filed on Mar. 11, 1999, now abandoned.

(51) Int. Cl.[7] ..... E21B 47/022
(52) U.S. Cl. ..... 33/313; 33/301
(58) Field of Search ..... 33/301, 302, 303, 33/304, 313, 324; 73/152.54

(56) References Cited

U.S. PATENT DOCUMENTS

| | | | | |
|---|---|---|---|---|
| 4,454,756 | A | 6/1984 | Sharp et al. | 73/151 |
| 4,666,300 | A | 5/1987 | Zollman et al. | 356/141 |
| 4,768,152 | A | 8/1988 | Egli et al. | 364/422 |
| 4,797,822 | A | 1/1989 | Peters | 364/422 |
| 4,812,977 | A | 3/1989 | Hulsing, II | 364/422 |
| 4,875,014 | A | 10/1989 | Roberts et al. | 324/326 |
| 4,953,638 | A | 9/1990 | Dunn | 175/61 |
| 4,987,684 | A | 1/1991 | Andreas et al. | 33/304 |
| 5,657,547 | A | 8/1997 | Uttecht et al. | 33/304 |
| 5,806,195 | A | 9/1998 | Uttecht et al. | 33/304 |
| 5,821,414 | A | 10/1998 | Noy et al. | 73/152.54 |

*Primary Examiner*—G. Bradley Bennett
(74) *Attorney, Agent, or Firm*—Robert W. Strozier; Donald Gunn

(57) ABSTRACT

A method of drilling under barriers (rivers, highways and the like) is set out. The horizontal drilling system mounts a guidance tool on the end of the drill string just behind the drill bit. The guidance tool includes a pair of right angle accelero meters and a 3-axis mounted gyro. The gyro furnishes data in a plane at right angles to the z-axis. This defines four data streams to the CPU enabling determination of drill bit location and pathway.

31 Claims, 2 Drawing Sheets

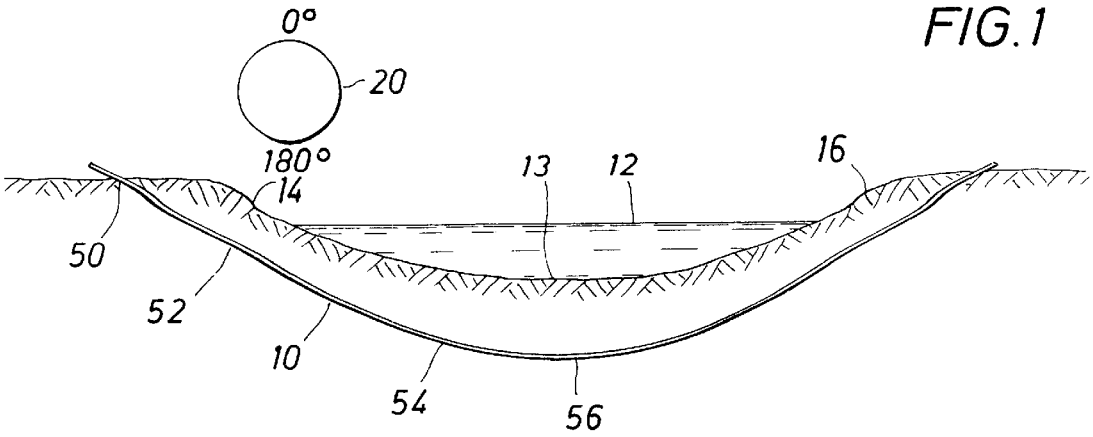
FIG. 1
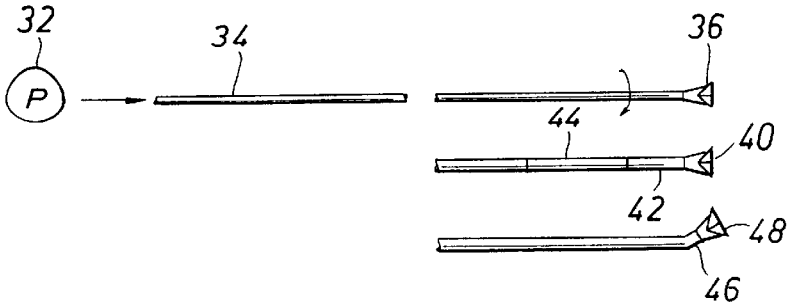
FIG. 3
FIG. 2
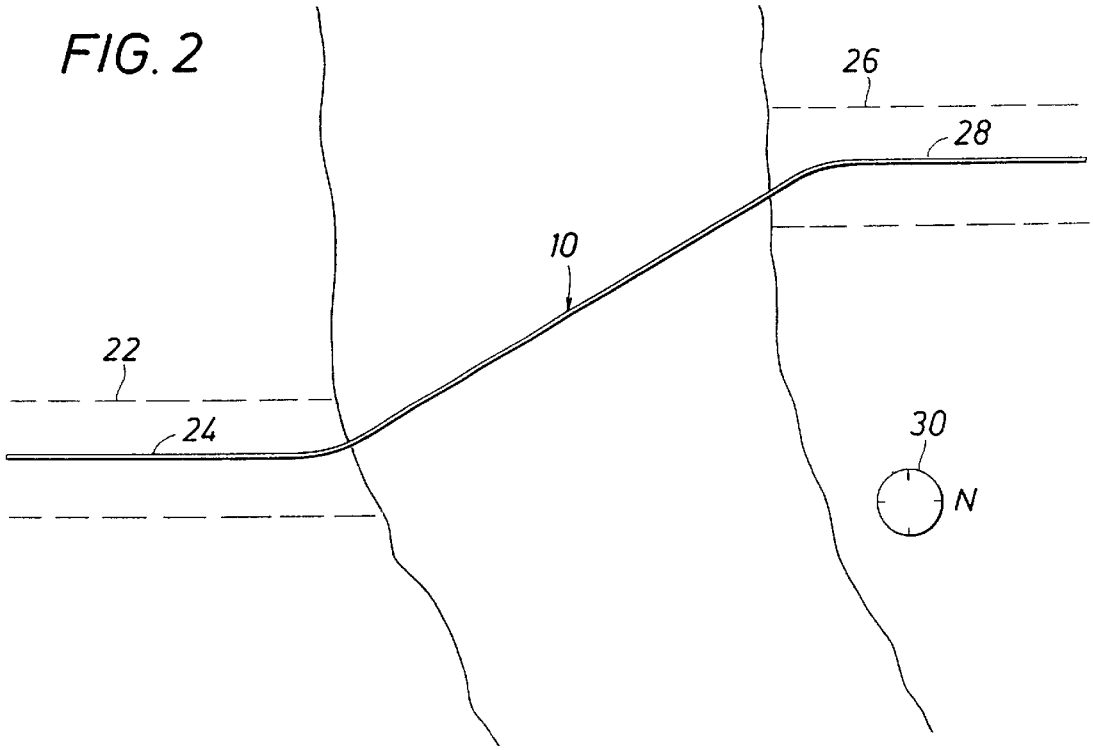

METHOD FOR DRILLING UNDER RIVERS AND OTHER OBSTACLES

RELATED APPLICATIONS

This application is a continuation of U.S. patent application bearing Ser. No. 09/266,566, filed Mar. 11, 1999, now abandoned.

BACKGROUND OF THE DISCLOSURE

This disclosure is directed to a method to form crossing under rivers and other natural barriers. The procedure accomplishes a river crossing which is the term that will be applied to crossing under a river with a pipeline. This term is sufficiently broad to also include rivers, highways, landing strips at airports and any other number of surface barriers. It may also be necessary to pass under large buildings where it is not possible to do tunneling or digging under the buildings. It is not uncommon to require river crossings of only a few hundred feet. For instance, crossing under rivers and swamps may require that a pipeline be buried perhaps 40 to 60 feet deep, perhaps 2,000 or 3,000 feet in length, and thereafter be restored to the normal grade position.

It is common to locate a pipeline about 4 to 8 feet below the surface. With undulating surfaces, the pipeline is still laid in a ditch or trench which is formed with that depth. The ditch will rise and fall as the terrain varies. There are times, however, when that is not so easily done. Trenching machines that are used to form pipelines must operate with a certain amount of right of way. Moreover, they operate on the surface, digging an open trench. It is not possible to run a trenching machine across a paved multiple lane highway. It is not possible to run a trenching machine over several railroad tracks, and it is exceedingly difficult to operate a trenching machine in a swamp. Even if the swamp water is only 2 or 3 feet deep, it normally is accompanied by a mud layer which makes heavy equipment manipulation difficult in the area.

Many situations can be encountered in long distance pipelines where river crossings must be done. A river crossing heretofore has involved the insertion of a string of drill pipe, not joints of a pipeline, into a well borehole by a drilling rig laid on its side, so to speak, and the string of drill pipe rotates a drill bit to form a hole which is more or less horizontal, not vertical. Ordinary drilling of wells involves vertical drilling from the surface. This departs immediately from that requirement, and involves drilling at a highly inclined angle, even approaching the horizontal at the surface where the drill string enters the earth. In drilling a typical well, the first several hundred feet are normally drilled vertically. A good deal of speed can be accomplished at the start. That, however, is not the case with a river crossing. Rather, the drill bit and drill string are inclined by inclining the derrick so that the initial launch of the drill pipe into the earth is nearly horizontal. To be sure, the hole formed by this approach angles downwardly to dive under the river crossing. It will, however, deflect later so that it turns back towards the surface on the far side of the river or other barrier. There is an entrance point on the near or first bank and an exit point on the far or second bank. Once the entrance and exit points have been established, the pipeline is installed with welded pipe in the well borehole which defines the river crossing. Because this involves two different kinds of pipe which have two different types of construction, it is necessary to position in the well borehole a string of pipe which is sized and constructed consistent with pipeline construction techniques. More will be noted concerning that below. The term "drill pipe" will be used to refer to pipe which is normally used in drilling a well borehole. Drill pipe terminates with a pin and box connection for easy threaded engagement. These pin and box connections typically include API standard threaded connections, or any of the several premium connections now available. There are premium threads which provide an enhanced mode of connection. Suffice it to say, pipe used in a pipeline is not joined by threaded connections. Rather, pipe line joints are formed by welding. The welded pipe is joined by welding in the field typically with welding machines which form a bead fully around the pipe so that there is no chance of leakage. In addition, the welded pipe is coated with some kind of corrosion protection material. For many years, the corrosion protection comprised a layer of tar and felt paper. There are other more modern coatings which are placed on the steel pipe. The pipe joints making up the pipeline must be protected from chemical reaction with the earth. Without this protection, the pipe will corrode more rapidly and the value and benefit of the pipe will be lost much sooner due to this corrosion.

The present disclosure sets forth an alternate use of the apparatus which is set forth in U.S. Pat. No. 5,821,414. It is been discovered that this apparatus can be installed in the form of a sonde which is placed in the drill pipe above the drill bit. This sonde includes a sealed chamber which encloses the measuring instruments. Preferably, it uses a pair of accelerometers which are mounted in a common horizontal plane transverse to the central axis of the sonde. They are positioned at right angles so that one will be described as the X-axis accelerometer or simply the X-accelerometer, and the other becomes the Y-accelerometer. It is theoretically possible to install a third accelerometer which is the Z-accelerometer, and to position along the axis of the sonde. That represent a data which would be otherwise redundant. While it can be included for added data to provide reduction of error, it can be omitted as the case may be. In another aspect, the equipment uses a gyroscope which is known as dual axis rate gyroscope. As before, the spin axis is aligned with the axis of the sonde. The dual axis rate gyro will be discussed in some detail below.

The apparatus of the present disclosure is summarized as a sonde which is adapted to be lowered or otherwise installed adjacent to the drill bit on a string of drill pipe used in a river crossing. It is located at that position so that it can provide information regarding the pathway achieved during drilling. It is used to monitor the pathway by providing that data in the form of azimuth and inclination. This enables steering of a smooth pathway. It provides data at the well head which enables control of the drilling process. Through the use of a bent sub and a jet flow of drilling mud through the bit, the pathway can be changed. Alternately, it can be used above a mud motor which cooperates with a steering tool to redirect the pathway.

SUMMARY OF THE INVENTION

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

FIG. 1 is a side view of a river crossing which shows a river between two banks, and a borehole pathway at a shallow angle extending from the left bank under the river and to the right bank;

FIG. 2 is a plane view of a different river crossing showing a change of direction in the river crossing to make connection between the left and right banks;

FIG. 3 is a view of a pump for delivering mud flow, a string of drill pipe, and alternate forms of connections made at the end of the drill string for advancing the drill bit;

DETAILED DESCRIPTION OF THE PREFERRED EMBODIMENT

Figure 4:
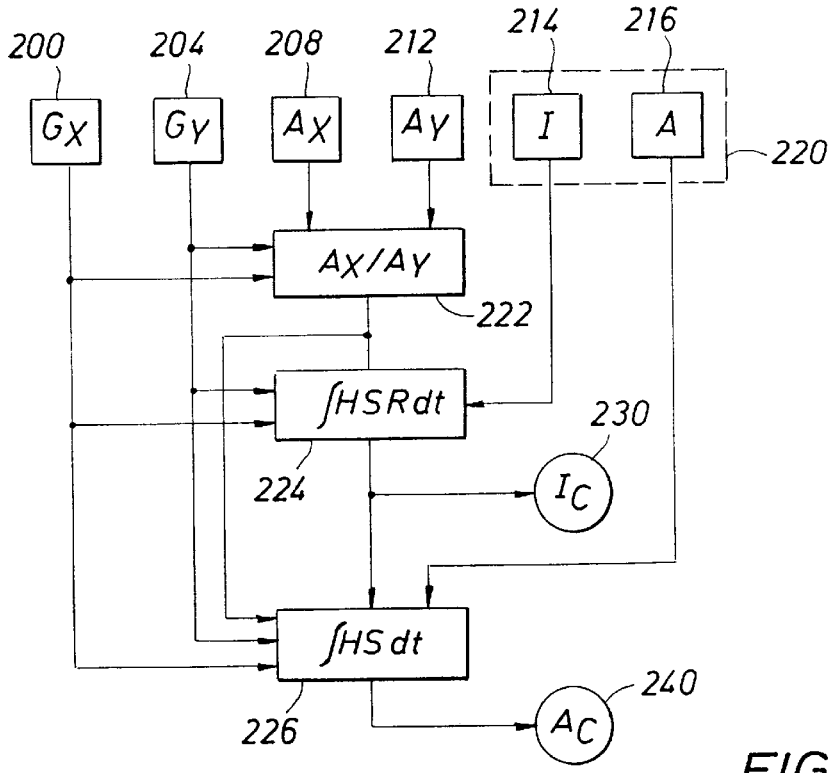
FIG. 4 is a block diagram schematic of data from sensors in the equipment which data is processed so that it forms a continuous presentation of drill bit azimuth and inclination.

The detailed description of the preferred embodiment is set forth below. As a beginning aspect, it is helpful to define the problem which is dealt with, and which places such extreme demands on drilling equipment and especially which requires precision steering of the drill string.

Exemplary River Crossing

Going now to FIG. 1 of the drawings, a representative river crossing is shown. In FIG. 1, the numeral 10 identifies a desired pathway. This pathway is calculated to pass under the river 12 which is shown above the pathway. The river 12 is confined between a left bank 14 and a right bank 16. It has a mud bottom 18. The water typically percolates into the soil for some depth so that it is very important to position the desired pathway at a greater depth than that. This desired pathway is determined in advance of drilling.

On the left bank, a pipeline or other mechanism for connection to the river crossing is established. The most commonplace situation involves a cross-country pipeline which approaches the left bank, continues under the river 12 with the river crossing, and then continues on beyond the right bank. It will be observed that the path 10 emerges from the ground area several feet back from the edge of the water. Primarily, this involves a set back so that there will be sufficient area to install the drilling equipment, form the pathway 10 under the river 12, and obtain the breakout of the drill bit at the far end. At the two exposed locations on the left and right banks, it is commonplace to then make arrangements to install the right kind of pipe along the path 10, the right kind being defined by the requirements for the pipeline. Also, it is commonplace to tie the pipe under the river into the cross-country pipeline, conforming with pipeline construction obligations which are imposed on the river on the pipe actually at the river crossing 10.

A match up of sizes should be noted. The common sizes of drill pipe are typically around four or five inches. Typically, the drill bit appended to the end of the drill pipe cuts a hole in the range of about 7 to about 10 inches. This type hole is usually formed by the tri-cone drill bit which finds common application in drilling vertical wells. These dimensions may or may not match up with those required for the pipeline. The pipeline itself may have a 30' to 60' right of way (ROW) and may involve a larger pipeline have nominal diameter of about 8 to 16 inches. Assume for purposes of discussion that the pipeline is a 12 inch line. For that size, it is then necessary to use a somewhat larger drill bit attached to the string of drill pipe as will be discussed thereby forming a larger diameter river crossing 10.

To thereby provide a reasonable and not unusual example, assume that the river crossing 10 will be drilled with 5 inch drill pipe supporting a drill bit which forms a cylindrical borehole at least 12 inches in diameter. Assume also that the pipe to be placed in the river crossing 10 matches up with the pipe of the pipeline which is 12 inch pipe. Practical aspects of these connections will be assumed to be executed, and the river crossing 10 will thus be used as the pathway for installation of the 12 inch pipe after drilling. In another aspect, FIG. 1 also includes a symbol 20 marking the angle of deflection. In this particular example, the angle of inclination will be spoken of several times. This establishes a reference namely that the vertical direction (defined by gravity) is an inclination of 180°. This definition will be spoken of several times. As will be seen, FIG. 1 is illustrative of the circumstances, namely that the river crossing 10 begins at an extreme angle.

Going now to FIG. 2 of the drawings, it shows the same or a different river crossing in plan view. FIG. 2 shows an ROW 22 at the left and a pipeline segment 24 which is installed in the conventional fashion. It is placed in the ROW typically by trenching with a trenching machine, and the pipe is then lowered into the trench and buried somewhere between 4 and 10 feet deep. Assume also that FIG. 2 shows a second ROW strip 26 with a continuation of the trench and pipeline location at 28. At this particular instance, the river crossing that needs to be accomplished is generally indicated at 10. This one is of note because it requires a straight line segment as well as an angular segment. More specifically, it is formed with a change in direction. The numeral 30 identifies a compass rose which is marked for the direction north to define the azimuth of the river crossing 10. In this instance, part is wholly straight, but it connects as illustrated to a curving segment.

Going back to FIG. 3 of the drawings, the numeral 32 identifies a mud pump which is represented schematically and which delivers a flow of drilling mud through a string of drill pipe 34. The drill pipe is typical for oil field usage and is commonly provided in 30 foot lengths. They join together with a pin and box threaded connection. It will be assumed to include API standard threaded connections. At the remote end, the drill pipe is provided with a rotary drill bit 36. It is advanced in drilling by rotation in the direction illustrated. The drill pipe may include or omit the conventional drill collars which are simply heavy weighted, thick wall, relatively stiff pipe sections. These are common in vertical holes because they help provide a true or vertical pathway. This keeps the drill bit from wandering as it drills, keeping in mind that the formation of a vertical well is done with similar equipment but encounters a significantly different set of obstacles and problems. In this instance, FIG. 3 shows a conventional string of drill pipe which is terminated in a typical tricone drill bit in which operates by rotation imparted from a rotary table at the derrick at the surface. The rotary table transmits rotation through the kelly threaded at the top of the drill string 34.

In FIG. 3 of the drawings, an alternate drill string is obtained by attaching a drill bit 40 at the end of a drill string. The drill bit 40 is rotated by a different type assembly. It again terminates with the drill bit 40 which is rotated by a mud motor 42 pointed in a direction which is determined by a steering mechanism 44. In another alternate form, a bent sub 46 can be affixed at the end of the drill string. It connects at the outlet end with a jet bit 48. Since the river crossing does not encounter rock in the ordinary circumstance, it is often possible to provide a sufficiently high pressure flow of drilling fluid that the fluid cuts away the earth by hydraulic action, not by rotary drilling. Guidance is achieved with the bent sub. The bent sub prompts lateral movement during drilling so that drilling is not straight, but curved and the bent sub can be used to control the curvature.

In general terms, all the foregoing is believed to be well known and is available for execution in making the river crossing. The problem with the foregoing techniques is that they must be guided carefully. Quite often, it is necessary to cross under a river with a crossing of perhaps 1,000 to about 2,000 feet, a distance which is relatively easy to handle in vertical hole, but which is somewhat tricky to accomplish in the river crossing context. One aspect of the difficulty derives from guidance of the drill bit as it advances the hole.

As noted with regard to the above mentioned U.S. Pat. No. 5,821,414 a system is set forth which involves a sonde which is lowered into the well borehole and more particularly into the drill pipe. This involves equipment which is located at the surface and also utilizes the downhole measuring instrument. The downhole sonde will be identified by the numeral 120. It will be explained in the context of the surface located equipment as well as the equipment located down hole. The sonde 120 is lowered in the well borehole (in the pipe) on the wireline cable 114 which brings data out of the hole.

Figure 5:
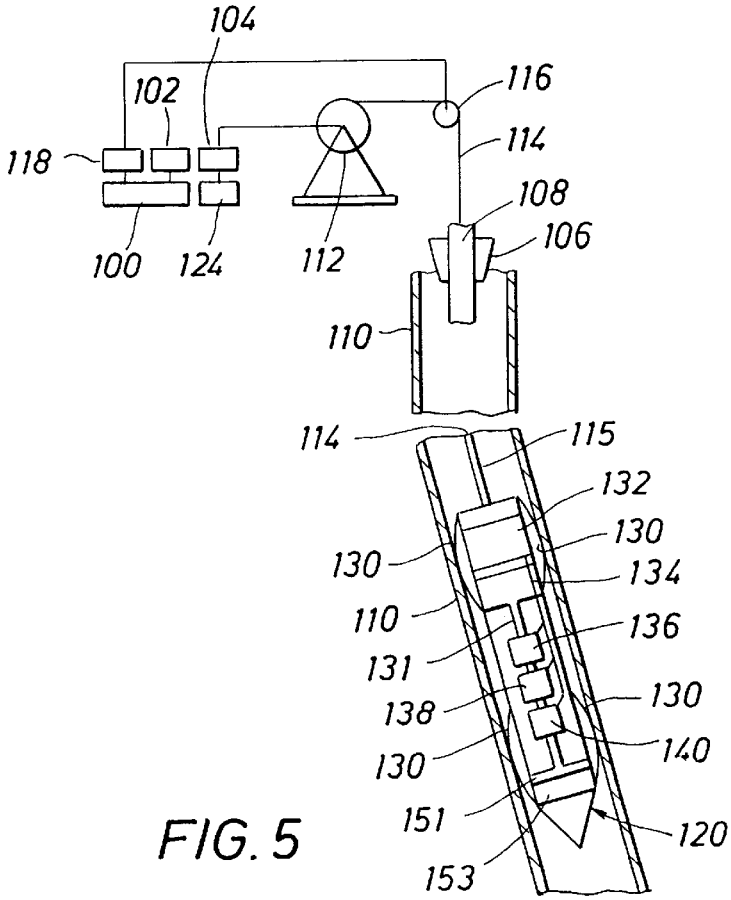
FIG. 5 is a sectional view through one form of sonde supported on a wire line which enables the sonde to be positioned in the string of drill pipe.

The surface equipment will first be discussed. The depth measuring equipment (DME) 118 cooperates with a central processing unit (CPU) 100 and a recorder 124. FIG. 5 also shows a surface interface 102 and a surface power supply 104 which provides power to the elements of the surface equipment. A drum 112 stores wireline cable 114, and deploys and retrieves the cable within the borehole. The cable 114 passes over a measure or sheave well 116 and extends into the wellbore through a set of slips 106 around a pipe 108. The wellbore is shown cased with casing 110.

The instrument probe 120, connected to one end of the wireline 114 by means of a cable head 115, is guided within the casing 110 by a set of centralizing bow springs 130. The probe 120 encloses an electronic assembly and power supply 132 which powers and controls other elements within the probe. A motor 134 rotates a gyro 136 by means of a shaft 131. The motor 134 also rotates the accelerometer assembly, shown separately as an X axis component 138 and a Y axis component 140, by means of the shaft 131. The shaft 131 is terminated at the lower end by a bearing assembly 151 and a lock assembly 153 which fixes the shaft 131 when the drive motor 134 is turned off. Probe instrumentation is relatively compact so the length and diameter of the survey probe 120 are relatively small. Furthermore, the instrumentation within the probe 120 is relatively simple thereby yielding a very reliable well survey system.

The apparatus mentioned above is operated in a continuous mode. As will be detailed in several examples below, a first measurement is made which obtains the values of azimuth and inclination. These are represented by the symbols A and I. They are measured with the sonde stationary at the surface. With initial values of A and I, values are then obtained continuously during continuous use of the equipment to provide updated incremental progression. From the beginning point, the values of A and I are calculated and are output to define a continuous smooth data corresponding to the location of the sonde in the well borehole. These calculations are executed by the system which is exemplified in FIG. 4 of the drawings.

The accelerometer outputs $A_x$ and $A_y$, represented by boxes 208 and 212, are used to form the ratio $A_x/A_y$ at the step represented by step 222. The outputs Gx and $G_y$, represented by the boxes 200 and 204, respectively, are combined with this ratio at step 222 to correct the ratio for any non gravity acceleration effects. The computation at step 222 yields the rate of roll over the HSR direction with respect to a reference rate of roll. This quantity is integrated over time, measured from a previously mentioned reference time to, which represents the initiation of the continuous mode operation, and combined with $G_x$ and $G_y$ at step 224 to yield a relative borehole inclination. This relative borehole inclination, when combined with the reference borehole inclination 214 stored in a memory device 220, yields the desired borehole inclination $I_c$ with the system operating in the continuous mode. The $I_c$ output is represented at 230.

Still referring to FIG. 4, the relative borehole inclination, Gx and $G_y$, and $A_x/A_y$, are combined and integrated over time, measured from to at step 226. This yields a continuous relative azimuth value measured with respect to A, the reference azimuth 216 stored within the memory 220. The relative azimuth is combined with the reference azimuth A at step 226 to yield the desired azimuth reading $A_c$, represented at 240, which in with the azimuth of the borehole computed with the survey system operating in the continuous mode of operation. As discussed previously, $I_c$ and $A_c$ are combined to yield a map of the borehole in three-dimensional space. All computations are preferably performed at the surface using a central processing unit defined in the following discussion of the system apparatus. To summarize, $A_c$ and $I_c$ are determined mathematically by integrating, over time, measured rates of change of inclination and azimuth with respect to measured, reference azimuth and inclination values. This approach greatly simplifies the downhole equipment required to obtain and accurate and precise map of the wellbore trajectory. The result is a smaller, more rugged survey instrument that those available in the prior art.

Typical River Crossing Sequence

Going now to FIG. 1 of the drawings, the numeral 50 identifies the beginning point of the river crossing 10. That is the point at which the initial values of inclination and azimuth are determined. Conveniently, these values can literally be obtained from a simple compass and plumb bob. Alternately, more expensive instrumentation can be used, but they are nevertheless the initial data. At that juncture, through the use of conventional and well known drilling equipment, drilling is initiated. Below, drilling is referred to as the progression of the river crossing 10 either by rotary drilling techniques which are well know, or alternately by the jetting techniques which again are well known. Several alternate procedures can be implemented, but the key is that they are executed using a string of drill pipe with a bit at the end (either a rotary bit or a jet bit) and the progression is extended throughout the river crossing. Indeed, if important, one can change to another type of drilling technique.

The sonde is lowered into the drill string 34 on the wireline which outputs data. It is somewhat inconvenient to have to slide each jointed pipe over the cable. However, this can be done without great loss of time and energy because the number of joints necessary to cross the river are limited. This approach enables all the data to be transmitted back to the surface. If appropriate, the wireline cable can be interrupted with a plug and socket for easy and convenient opening of the cable to thereby install added joints of pipe. In any event, the location 50 is the position or location of the first data point. The point 52 represents the location of another data point. The location 54 represents another data point, and the location 56 represents a data point that is approximately at the bottom of the trajectory-of the river crossing 10.

The points 50, 52, 54, and 56 are typical data point locations where the measurements are made and data transmitted out. In the most common procedure, these points can normally coincide with the point in the sequence of operation where it is necessary to stop the drilling process, install another joint of pipe, and then continue. At that stage, it is necessary to interrupt the process, thereby prompting the sonde to stop its movement downwardly. In other words, the hole is no longer progressing. When the drilling stops, the sonde is supported at a fixed location and another data point can then be obtained. While the sonde is operated in a continuous fashion, the data points 52, 54, and 56 typically coincide with stopping points in the drilling process. Because they are stopping points, such stopping points enable the process to collect data which updates the description of the river crossing 10. In other words, the data is collected as the river crossing is formed. Because that data is available from the sonde and is provided quickly, the pathway of the sonde is known even better and steering control is then established to assure that the pathway is achieved. By obtaining data continuously, but especially by using data when the drilling process is interrupted, which interruption occur every 30 feet (equal to the length of one joint of drill pipe), the driller can then provide continual correction of the path of the river crossing 10 so that it can be controlled, changed and enhanced. Doing this enables the path to be extended indefinitely and under control. Control apparatus has not been shown in this disclosure because it is believed to be well known, i.e. control via steering tools and the like is a well developed technique. By this approach, the entire river crossing can be handled in terms of changes in depth. Depth changes involve changes in inclination. As shown in FIG. 1, the inclination initially is downwardly, but it ends up moving upwardly prior to emerging beyond the right bank 16. In like fashion, FIG. 2 shows changes in azimuth. Whether drilling from the left bank to the right or in the reverse direction, it is necessary to change the azimuth on more than one occasion to assure that the river crossing 10 makes appropriate connection with the ROW on the far bank.

For a better understanding of the progressive or continuous operation sequence, the above mentioned U.S. Pat. No. 5,821,414 develops substantial teaching on the three dimensional problem that is encountered and which is measured through the use of the sensors in the sonde 120. In particular, this disclosure incorporates by reference the discussion of that problem in space which begins with column 6, line 54 of that disclosure. Once the drill bit comes out of the earth at the distal end, the procdure is ended. The bit is removed and the string of drill pipe is pulled out of the crossing 10. At this stage, the pipe sections of the pipeline are attached and pulled into the crossing 10, advancing joint by joint as the drill string is pulled back. This enables the pipeline to be put in place for the crossing 10; the last steps involve welding the pipeline sections to the partially assembled pipeline.

While the foregoing is directed to the preferred embodiment, the scope can be determined from the claims which follow.

What is claimed is:

1. A method of measuring location while forming a borehole with a drilling tool, the borehole crossing under an earth surface obstacle, the method comprising the steps of:

(a) moving an elongate sensor housing having an axis coincident therewith along the borehole to form measurements while drilling under the earth surface obstacle, the housing mounted for common movement with the drilling tool;

(b) positioning a rate gyro in said housing wherein said rate gyro forms output signals indicative of measured angular rate and taking a set of measurements to initialize the gyro at a first position;

(c) positioning in said housing first and second accelerometers at a right angle therebetween wherein said accelerometers define a transverse plane to the axis of said housing, and forming outputs indicative of values sensed thereby during movement between first and second positions in said borehole;

(d) forming subsequent data representative of the outputs of said rate gyro and said accelerometers during movement between said first and second positions along the borehole;

(e) forming subsequent accelerometer data representative of said accelerometer output signals, during movement between said first and second positions along the borehole; and (f) converting said rate gyro data and said accelerometer data into a plot of the borehole.

2. The method of claim 1 wherein said housing is an elongate cylindrical housing and including the step of moving said housing along the borehole in a continuous motion between said first and second positions.

3. The method of claim 1 wherein said rate gyro is initially oriented to define an axis thereof coincident with the axis of said housing, and forming resolved X and Y components in said housing while moving between said first and second positions.

4. The method of claim 1 wherein said rate gyro is provided with first and second rate sensors at right angles for forming said rate gyro signals in X and Y axes with respect to the Z axis of the rate gyro, and further including the step of positioning the rate gyro so that the Z axis thereof coincides with said housing, and subsequently calculating azimuth from said rate gyro.

5. The method of claim 1 wherein said first and second positions are in a borehole inclined by a specified angle from the vertical.

6. A method of measuring along a borehole crossing under an earth surface obstruction, the method comprising the steps of:

(a) moving an elongate sensor housing having an axis coincident therewith along a borehole to measure first and second positions, wherein said first and second positions are at the earth's surface and the borehole is substantially below the earth's surface;

(b) positioning a rate gyro in said housing wherein said rate gyro forms output signals indicative of measured angular rate at first and second positions;

(c) positioning in said housing first and second accelerometers at a right angle therebetween wherein said accelerometers define a transverse plane to the axis of said housing, and forming outputs from said first and second accelerometers indicative of values sensed at first and second positions in said borehole and relative to a reference inclination;

(d) converting data representative of the outputs of said rate gyro and said accelerometers during movement between said first and second positions along the borehole to determine borehole inclination; and (e) recording a plot of borehole inclination to form a plot between said first and second positions.

7. The method of claim 6 wherein said positions have different azimuth.

8. The method of claim 6 wherein said housing is suspended on an elongate wire line in a drill string and said wireline is moved to move said housing along a drilling borehole and movement of said housing is measured as a function of depth to form a record thereof.

9. The method of claim 6 wherein said housing is an elongate cylindrical housing and including the step of moving said housing along the borehole suspended from a cable and moving said housing in a continuous motion between said first and second positions to obtain azimuth between said first and second position.

10. The method of claim 9 wherein said rate gyro is initially oriented to define an axis thereof coincident with the axis of housing, and forming resolved X and Y components of movement of said rate gyro in said housing while moving between said first and second positions.

11. The method of claim 6 wherein said rate gyro is provided with first and second rate sensors at right angles for forming gyro rate output signals in X and Y axes with respect to the Z axis of the rate gyro, and further including the step of restoring the rate gyro so that the Z axis thereof coincides with s aid housing, and subsequently calculating borehole azimuth with respect to a reference azimuth measured with said rate gyro and with said 6 sensor housing stationary at said first position.

12. The method of claim 11 wherein said first and second positions are in a borehole inclined by a specified angle from the vertical.

13. A method of controlling an earth surface obstacle crossing borehole comprising the steps of:

(a) moving an elongate sensor housing having an axis coincident therewith along a borehole between first and second selected positions to form a control signal between said first and second positions;

(b) positioning a rate gyro in said housing wherein said rate gyro forms output signals indicative of measured angular rate between said first and second positions;

(c) positioning in said housing first and second accelerometers at a right angle therebetween wherein said accelerometers define a transverse plane to the axis of said housing, and forming outputs from said first and second accelerometers indicative of values sensed thereby during movement between first and second positions in said borehole with respect to a reference inclination at said first position;

(d) forming data representative of the outputs of said rate gyro with respect to a reference azimuth at said first position and said accelerometers during movement between said first and second positions along the borehole to determine borehole azimuth and inclination; and (e) controlling borehole azimuth and inclination between said first and second positions.

14. The method of claim 13 wherein said housing is an elongate cylindrical housing and including the step of moving said housing along the borehole suspended from a cable and moving said housing between said first and second positions.

15. The method of claim 13 wherein said rate gyro is provided with first and second rate sensors at right angles for forming gyro rate output signals in X and Y axes with respect to the Z axis of the rate gyro, and further including the step of positioning the rate gyro so that the Z axis thereof coincides with said housing to direct said housing axis along said borehole, and determining azimuth from said rate gyro.

16. The method of claim 13 wherein said first and second positions are in a borehole inclined by a specified angle from the vertical.

17. The method of claim 13 wherein said rate gyro is initially oriented to define an axis thereof coincident with the axis of said housing, and forming resolved X and Y components of movements of said rate gyro in said housing while moving between said first and second positions.

18. The method of claim 17 wherein said housing is suspended on an elongate wireline in said borehole to move said housing along in said borehole and movement of said housing is measured as a function of depth to form a record thereof.

19. A method of guiding a river crossing borehole comprising the steps of:

(a) moving an elongate sensor housing along a borehole between first and second selected positions to survey the river crossing between said first and second positions as the borehole is being bored;

(b) positioning a rate gyro in said housing wherein said rate gyro forms orthogonal output signals indicative of measured angular rate between said first and second positions;

(c) positioning in said housing first and second accelerometers at a right angle therebetween wherein said accelerometers define a transverse plane to the axis of said housing;

(d) measuring a reference azimuth and a reference inclination at the start of the river crossing and computing and storing data representative of the outputs of said rate gyro relative to said reference azimuth and said accelerometers relative to said reference inclination between said first and second positions along the borehole; and (e) converting the stored data into a plot of borehole azimuth between said first and second positions.

20. The method of claim 19 wherein said housing is an elongate cylindrical housing and including the step of moving said housing along the borehole in a continuous motion between said first and second positions.

21. The method of claim 19 including the step of creating a Z axis output from accelerometer data.

22. The method of claim 21 including the step of setting the reference horizontal plane relative to gravity.

23. The method of claim 21 including the step of projecting the gyro output data into a horizontal plane for measuring inclination from the gyro data.

24. A method of conducting a river crossing survey along a borehole comprising the steps of:

(a) moving an elongate sensor housing along a borehole between a start and second selected positions to form a survey between said first and second positions;

(b) positioning a rate gyro in said housing wherein said rate gyro forms orthogonal output signals indicative of measured angular rate between said start and second positions;

(c) positioning in said housing start and second accelerometers at a right angle therebetween wherein said accelerometers define a transverse plane to the axis of said housing;

(d) measuring gravity induced signals at the start position and determining therefrom a vector component describing the start position wherein the component includes well borehole inclination;

(e) measuring at the first position a vector component describing housing azimuth;

(f) moving the housing along the borehole from the start to a second position in the borehole;

(g) outputting data representing the inclination and azimuth, between start and positions;

(h) measuring a reference azimuth and a reference inclination at said start position and computing and storing data representative of the output of said rate gyro relative to azimuth;

(i) storing data representative of said accelerometers relative to inclination; and (j) converting the stored data into a control signal for borehole azimuth between said start and second positions.

25. The method of claim 24 including the step of measuring linear travel of said housing along the borehole between the start and second positions.

26. The method of claim 24 including the step of measuring housing rotation as indicated by signals from said accelerometers.

27. The method of claim 24 including the step of measuring data from said rate gyro indicative of relative rotation of said housing in space from said start position.

28. A method of controlling drilling of a river crossing along a well borehole comprising the steps of:

(a) moving an elongate sensor housing along a well borehole from a start to a second position along the well borehole, the sensor mounted on a drilling tool used to drill the river crossing;

(b) measuring angular rate of the housing on movement from said start to the second position;

(c) placing first and second accelerometers at a right angle in said housing wherein said accelerometers define a transverse plane to axis of said housing;

(d) measuring gravity induced signals from said first and second accelerometers along the river crossing;

(e) determining the well borehole inclination;

(f) determining a vector component describing housing azimuth;

(g) moving the housing along the well borehole to a second position in the well borehole;

(h) forming data representing the inclination and azimuth; and (i) converting the data into a plot of river crossing azimuth.

29. The method of claim 28 including the step of measuring linear travel of the housing along the well borehole.

30. The method of claim 28 including the step of measuring housing rotation as indicated by signals from the accelerometers.

31. A method of guiding drilling of a river crossing comprising the steps of:

positioning a sensor housing in a drill string;

positioning a gyro in the housing wherein the gyro forms orthogonal output signals responsive to gyro operation with housing movement along the river crossing;

positioning two orthogonal accelerometers in a plane traverse to the housing to form accelerometer output signals;

defining from the orthogonal accelerometer signals tool high side at a start time of the river crossing;

determining at the start time of the river crossing a position of the gyro as indicated by the output signals of the gyro; and moving the housing along the river crossing from the start time to a second time; and determining between the start and second times rotation of the housing around an axis along the well borehole in response to the output signals.

* * * * *